United States Patent [19]

Stedman

[11] 4,069,932

[45] Jan. 24, 1978

[54] FORK LIFT TRUCK

[75] Inventor: Robert N. Stedman, Chillicothe, Ill.

[73] Assignee: Caterpillar Tractor Co., Peoria, Ill.

[21] Appl. No.: 752,770

[22] Filed: Dec. 20, 1976

[51] Int. Cl.[2] ..... B66F 9/14

[52] U.S. Cl. ..... 214/730; 187/9 R; 187/9 E; 187/17; 214/701 P; 214/DIG. 7

[58] Field of Search ..... 214/672, 674, 730, DIG. 7; 187/9 R, 9 E, 17, 20

[56] References Cited

U.S. PATENT DOCUMENTS

| | | | |
|---|---|---|---|
| 2,106,878 | 2/1938 | Sinclair | 187/9 R |
| 2,212,711 | 8/1940 | MacIsaac | 214/672 |
| 3,061,127 | 10/1962 | Hallsworth | 214/672 |
| 3,203,568 | 8/1965 | Quayle | 187/9 R |
| 3,374,901 | 3/1968 | Ferwerda | 187/9 R |
| 3,701,442 | 10/1972 | Dunning et al. | 187/9 R |
| 3,913,765 | 10/1975 | Ramsey | 214/701 P |
| 3,997,029 | 12/1976 | Evans | 214/DIG. 7 |

FOREIGN PATENT DOCUMENTS

| | | | |
|---|---|---|---|
| 1,136,619 | 10/1956 | France | 214/672 |
| 1,402,692 | 8/1975 | United Kingdom | 187/9 R |

*Primary Examiner*—Lawrence J. Oresky
*Attorney, Agent, or Firm*—John W. Grant

[57] ABSTRACT

A fork lift truck includes an operator's protective structure carried on a longitudinally extending frame. The protective structure has a channel member which also forms part of a lift mast assembly. Certain components of the protective structure are hollow and have the hydraulic lift jack and portions of the lift chain disposed therein.

5 Claims, 5 Drawing Figures

27
53
22
24
51
59
57
71
67
56
68
66
64
54
52
69
72
62
63
58
73
74
23
26
10
14
38
36
18
39
37
34
17
36
41
31
43
32
16
76
12
13
11

FORK LIFT TRUCK

BACKGROUND OF THE INVENTION

Fork lift trucks commonly include upwardly extending uprights on which a load support carriage is guided for up and down movement. The carriage is raised and lowered by on or a pair of hydraulic lift jacks mounted in a vertical position between the uprights and connected to the load carriage through chains or cables. Due to the position of the lift jacks and chains between the uprights, they present a substantial obstruction to the view of the operator through the uprights. This creates a problem when maneuvering the truck particularly during engaging or depositing a load since the operator does not have a clear view of the forks.

SUMMARY OF THE INVENTION

The present invention is directed to overcoming one or more of the problems as set forth above.

According to the present invention there is provided a fork lift truck having a longitudinally extending frame. An operator's protective structure includes an upwardly extending channel member having its lower end portion fastened to a first portion of the frame, an upwardly extending hollow post having its lower end portion fastened to a second portion of the frame and a longitudinally extending hollow beam extending between and secured to the upper end portions of the channel member and post. A load supporting device is mounted for up and down movement along the channel member. A hydraulic lift jack is disposed within the post and has a first element anchored to the post and a second element movable relative to the first element. A first sheave is rotatably attached to the second element. A second sheave is rotatably mounted within the passageway formed by the post and beam at a location adjacent the post. A third sheave is rotatably attached to the protective structure thereof adjacent the channel member. An elongated flexible element is connected to the load supporting device and extends upwardly therefrom around the third sheave, through the beam, around the second sheave, downwardly and around the first sheave and anchored to the post.

DETAILED DESCRIPTION OF THE INVENTION

Figures 1, 5:
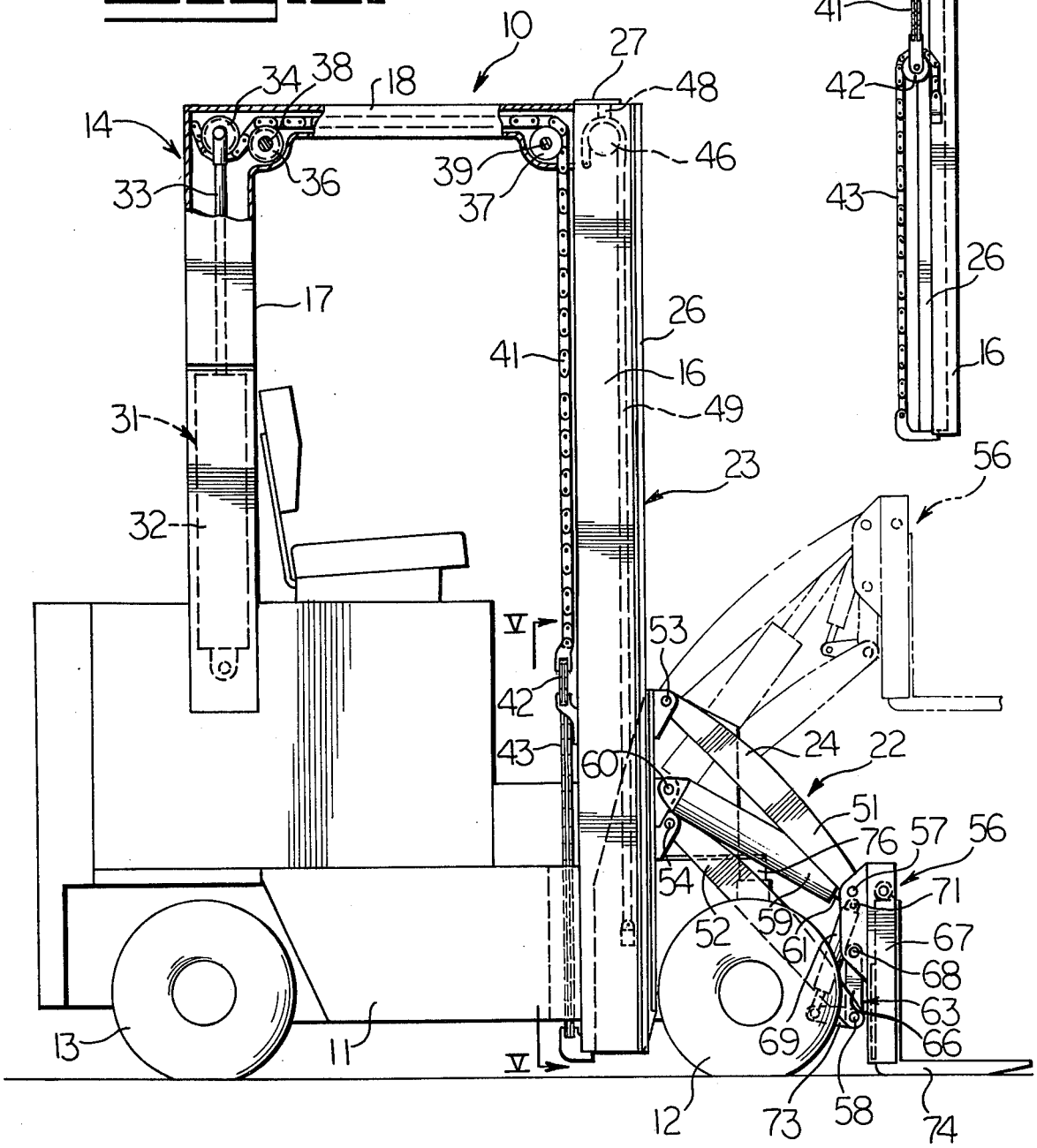
FIG. 1 is a side elevational view of a fork lift truck.
FIG. 5 is a fragmentary elevational view of one of the lift chains.

Referring to the drawings, a fork lift truck is generally indicated by the reference numeral 10 and has a longitudinally extending frame 11 carried by pairs of front and rear wheels 12 and 13, respectively.

An operator's protective structure 14 is carried by the frame and includes a pair of laterally spaced upwardly extending channel members 16. The lower end portions of the channel members are fastened to the frame and are disposed rearwardly of and substantially in line with the front wheels 12. A pair of laterally spaced upwardly extending hollow posts 17 have their lower end portions fastened to the rearward portion of the frame. A pair of laterally spaced, longitudinally extending hollow beams 18 individually extend between and are secured to the upper end portions of the channel members and posts.

Figure 3:
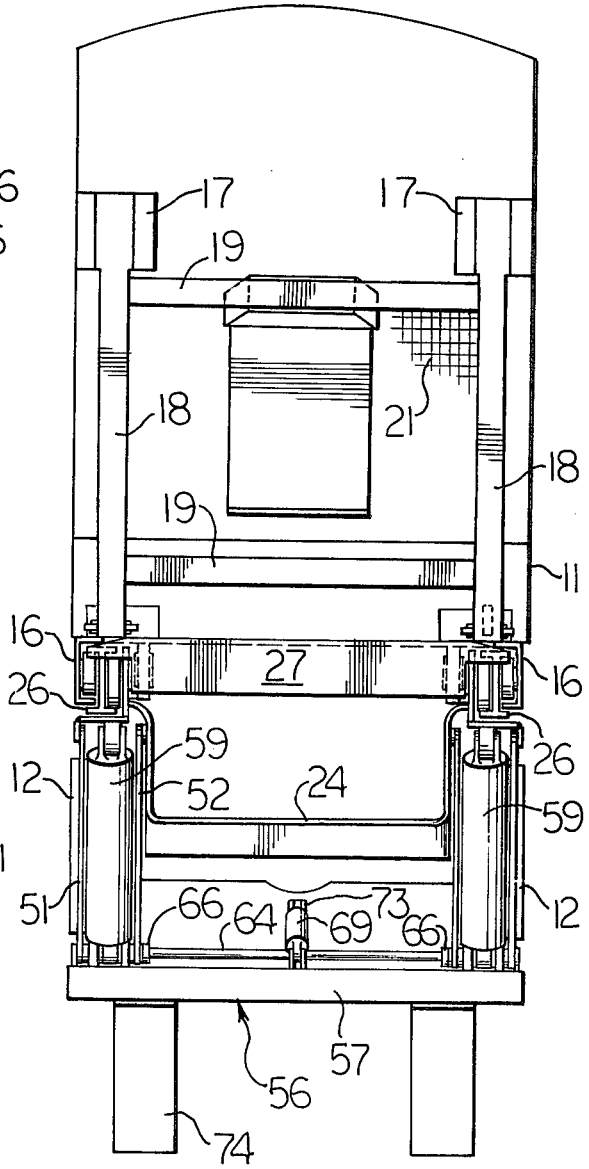

Referring to FIG. 3 the channel members 16 have a generally U-shaped cross section and open toward each other. A plurality of longitudinally spaced cross bars 19 extend between and are rigidly secured to the beams 18 and are covered with an apertured material such as wire screen 21 to protect the operator from falling objects.

Figure 4:
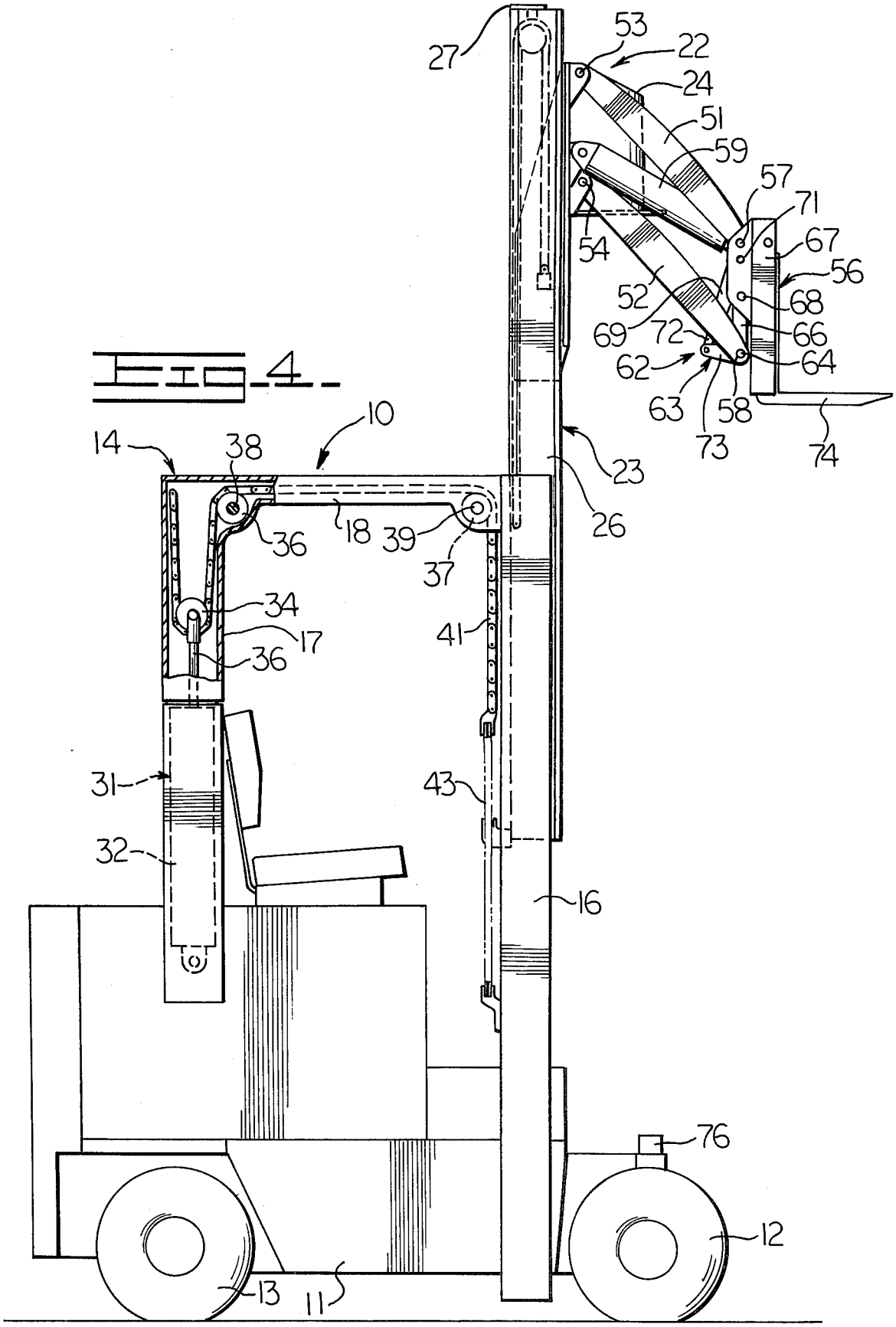
FIG. 4 is a side elevational view of the fork lift truck with the forks in a partially elevated position.

Referring to FIGS. 1 and 4, a load supporting device 22 is mounted for up and down movement along the channel members 16. The load supporting device includes an inner mast section 23 mounted for telescopic up and down movement relative to and along the channel members and a fork carriage 24 mounted for up and down movement relative to the movable mast section in the usual manner such as by a plurality of rollers. The inner mast section has a pair of laterally spaced "I" beam channels 26 disposed between the channel members 16 and are rigidly interconnected by structural members including a cross plate 27 secured to the upper ends of the channels.

A hydraulic lift jack 31 is disposed witin each of the hollow posts 17 and has its cylinder 32 anchored to the post. A piston rod 33 is reciprocable within the cylinder and has a first sheave 34 rotatably attached to its end portion.

Second and third sheaves 36 and 37 are rotatably mounted within each passageway formed by the respective post 17 and beam 18 on pins 38 and 39, respectively, fastened to the protective structure 14. The second and third sheaves are disposed at locations adjacent the post and channel member, respectively. It is to be understood, however, that the third sheave can be positioned at other limited locations without departing from this invention. For example, the forward end of each beam may be secured to a lateral side of the channel member and the third sheave rotatably mounted to the upper end of the channel member in alignment with the beam.

Each of a pair of elongated flexible elements such as chains 41 rotatably carry a fourth sheave 42, FIG. 5, on one of its ends adjacent the rear edge of the respective channel member 16. Each chain extends upwardly adjacent the rear edge of the channel member and through an opening in the lower side of the respective beam 18, loops over the respective third sheave 37, extends rearwardly through the respective beam, loops over the respective second sheave 36, extends downwardly under and around the first sheave 34 and has its other end anchored to the upper end portion of the respective post 17. As shown in FIG. 5, each of a pair of second elongated flexible elements or chains 43 is looped over the respective fourth sheave and has one end anchored to the adjacent channel member 16 and its other end attached to the respective "I" beam channel 26 of the inner mast section 23.

Figure 2:
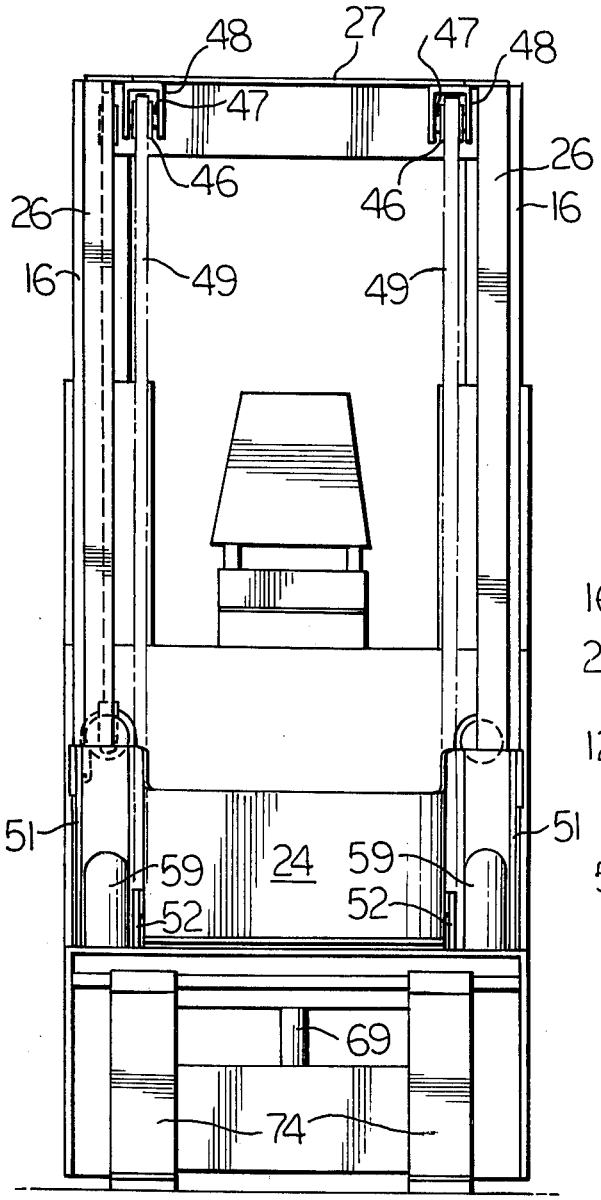
FIGS. 2 and 3 are front elevational and top plan views, respectively, of the fork lift truck of FIG. 1.

Referring to FIGs. 1 and 2, a pair of fifth sheaves 46 are rotatably attached to the upper end portion of the inner mast section at opposite sides thereof on pins 47, each of which is carried by a bracket 48 secured to the cross plate 27. Each of a pair of third elongated flexible elements or chains 49 is looped over the respective fifth sheave and has one of its ends anchored to the channel member 16 and its other end attached to the fork carriage 24.

Thus, retracting the piston rods 33 of the lift jacks 31 from their extended position shown in FIG. 1 causes the first chains 41 to pull the fourth sheaves 42 upwardly which in turn cause the second chains 43 to move the inner mast section 23 upwardly relative to the channel members 16. This in turn causes the third chains 49 to move the fork carriage 24 upwardly relative to the inner mast section.

Referring to FIGS. 1 and 2, first and second pairs of laterally spaced longitudinally extending rigid links 51 and 52 have their rearward end portions pivotally attached to the fork carriage 24 by vertically spaced first and second pivots 53 and 54, respectively, and their forward end portions pivotally attached to a fork assembly 56 by vertically spaced third and fourth pivots 57 and 58, respectively. As viewed in FIGS. 1 and 4, the linear distance between the first and second pivots is substantially equal to the linear distance between the third and fourth pivots and the linear distance between the first and third pivots is substantially equal to the linear distance between the second and fourth pivots. This forms a four-bar parallelogram linkage so that the fork assembly remains in substantially the same attitude as it is raised relative to the fork carriage 24.

Each of a pair of hydraulic jacks 59 is pivotally anchored to one side of the fork carriage 24 at a pivot 60 intermediate the first and second pivots 53 and 54. A piston rod 61 of the hydraulic jack is pivotally connected to the fork assembly 56 at the third pivot 57. Thus extending the piston rods of the hydraulic jacks from their retracted position shown by solid lines in FIG. 1 causes the links 51 and 52 to pivot about the first and second pivots thereby raising the fork assembly to the position shown by broken lines in FIG. 1. It is to be understood that raising or lowering of the fork assembly relative to the fork carriage can be accomplished with the movable mast section and the fork carriage at any elevational position.

A fork tilt mechanism 62 is provided as part of the fork assembly 56 and includes a bell crank 63 which has its apex pivotally connected to the forward end portions of the second links 52 by the fourth pivot 58. The fourth pivot includes a transversely extending rod 64, FIG. 3, which protrudes through suitable bores in the forward end portions of the second links. Each of a pair of vertically extending arms 66 of the bell crank is pivotally connected to a fork support frame 67 at a fifth pivot 68 which is disposed intermediate the third and fourth pivots 57 and 58. A hydraulic tilt jack 69 is pivotally connected to the support frame at a sixth pivot 71 disposed between the third and fifth pivots. A piston rod 72 of the tilt jack is pivotally connected to another arm 73 of the bell crank. As more clearly shown in FIG. 3, the bell crank is a fabricated structure wherein each of the arms 66 are fixedly secured to the outer end portions of the rod 64 and the other arm is fixedly secured to the mid portion of the rod.

In use, extending the piston rod 72 of the tilt jack 69 from its position shown in FIGS. 1 and 4 rotates the bell crank 63 counterclockwise about the fourth pivot 58. The bell crank in turn rotates the fork support frame 67 clockwise about the third pivot 57 so that the tips of a pair of forks 74 carried on the fork support frame are angled downwardly. Conversely, retracting the jack would raise the tips of the forks. It is to be understood that tilting of the forks can be accomplished at any elevational position of the fork assembly relative to the fork carriage.

A rubber pad 76 is mounted on the forward end portion of the frame 11 beneath the fork carriage 24 at a location for resiliently supporting the fork carriage in its lowered position shown in FIG. 1. This permits the stress or load on the lift chains to be relieved when a load is being transported on the forks 74 since the fork assembly can be raised while the fork carriage remains supported by the rubber pad.

Other aspects, objects and advantages will become apparent from a study of the drawings, the disclosure, and the appended claims.

The embodiments of the Invention in which an exclusive property or privilege is claimed are defined as follows:

1. A fork lift truck comprising:

a longitudinally extending frame having an operator's station;

an operator's protective structure extending in front, over, and in back of said operator's station in the form of an overhead guard having an upwardly extending channel member having its lower end portion fastened to a first portion of the frame, an upwardly extending hollow post having its lower end portion fastened to a second portion of the frame, and a longitudinally extending hollow beam extending between and secured to the upper end portions of the channel member and the post;

a load supporting device including forks mounted for up and down movement along the channel member;

a hydraulic lift jack disposed within and completely surrounded by the post and having a first element anchored to the post and a second element movable relative to the first element;

a first sheave rotatably attached to the second element;

a second sheave rotatably mounted within the passageway formed by the post and beam at a location adjacent the post;

a third sheave rotatably attached to the protective structure adjacent the channel member; and an elongated flexible element connected to the load supporting device and extending upwardly therefrom around the third sheave, through the beam, around the second sheave, downwardly and around the first sheave and anchored to the post.

2. The fork lift truck of claim 1 including a fourth sheave rotatably attached to one end of the lifting element and a second elongated flexible element looped over the fourth sheave and having one of its ends anchored to the respective channel member and its outer end attached to the load supporting device.

3. The fork lift truck of claim 2 wherein the load supporting device includes a movable mast section mounted for up and down movement along and relative to the channel member, and a fork carriage mounted for up and down movement relative to the mast section, said other end of the second flexible element being attached to the movable mast section; and including a fifth sheave rotatably attached to the upper end portion of the mast section, and a third elongated flexible element looped over the fifth sheave and having one of its ends anchored to the channel member and its other end attached to the carriage.

4. The fork lift truck of claim 3 including a fork assembly; first and second longitudinally extending rigid links having first end portions pivotally attached to the carriage by first and second pivots and second end portions pivotally attached to the fork assembly by third and fourth pivots, the linear distance between the first and second pivots being substantially equal to the linear distance between the third and fourth pivots, and the linear distance between the first and third pivots being substantialy equal to the linear distance between the second and fourth pivots; and a hydraulic motor pivotally anchored to the carriage and pivotally connected to the fork assembly for raising and lowering the fork assembly relative to the carriage.

5. The fork lift truck of claim 3 including a resilient member mounted on the first portion of the frame beneath the fork carriage.

* * * * *